US009903108B2

(12) United States Patent
Flint et al.

(10) Patent No.: US 9,903,108 B2
(45) Date of Patent: Feb. 27, 2018

(54) WEEP HOLE INSERT SYSTEM

(71) Applicants: John Noel Flint, West End (AU); Lynne Oldfield, West End (AU)

(72) Inventors: John Noel Flint, West End (AU); Lynne Oldfield, West End (AU)

( * ) Notice: Subject to any disclaimer, the term of this patent is extended or adjusted under 35 U.S.C. 154(b) by 0 days.

(21) Appl. No.: 14/908,620

(22) PCT Filed: Feb. 14, 2014

(86) PCT No.: PCT/AU2014/000123
§ 371 (c)(1),
(2) Date: Jan. 29, 2016

(87) PCT Pub. No.: WO2015/013736
PCT Pub. Date: Feb. 5, 2015

(65) Prior Publication Data

US 2016/0208481 A1 Jul. 21, 2016

(30) Foreign Application Priority Data

Aug. 1, 2013 (AU) ..... 2013211506

(51) Int. Cl.
*E04B 1/66* (2006.01)
*E04B 1/70* (2006.01)
*E04B 1/72* (2006.01)

(52) U.S. Cl.
CPC ..... *E04B 1/7053* (2013.01); *E04B 1/7061* (2013.01); *E04B 1/7076* (2013.01); *E04B 1/72* (2013.01)

(58) Field of Classification Search
CPC ..... E04B 1/7053; E04B 1/72; E04B 1/7076; E04B 1/7061
USPC .. 52/302.1, 302.3, 302.4, 302.6, 302.7, 101, 52/517
See application file for complete search history.

(56) References Cited

U.S. PATENT DOCUMENTS 3,508,369 A * 4/1970 Tennison ..... E04B 1/6803 404/69
3,640,039 A * 2/1972 McKee ..... E04B 1/6158 52/281
4,102,093 A 7/1978 Harris
4,386,482 A * 6/1983 Quinif ..... E06B 3/825 49/489.1
5,203,795 A * 4/1993 Balamut ..... E04B 1/0023 43/124
6,044,594 A * 4/2000 Desselle ..... E04B 1/7053 52/101
6,474,031 B2 * 11/2002 Phillips ..... E04B 1/7053 52/101
7,302,776 B2 * 12/2007 Duncan ..... E04D 13/17 454/260
8,171,677 B2 * 5/2012 Flint ..... E04B 1/7053 52/101

(Continued)

FOREIGN PATENT DOCUMENTS

AU 762230 B2 6/2003
EP 1566499 A1 8/2005
WO 2009003230 A1 1/2009

*Primary Examiner* — Chi Q Nguyen
(74) *Attorney, Agent, or Firm* — David Guerra

(57) ABSTRACT

Disclosed herein is a weep hole insert (10, 10') for providing a barrier in a weep hole (11). A handle (24, 24') for facilitating insertion of the insert (10, 10') in the weep hole (11) is also disclosed.

20 Claims, 6 Drawing Sheets

(56) References Cited

U.S. PATENT DOCUMENTS

2008/0276556 A1* 11/2008 Flint ..... E04B 1/7069
52/302.1
2015/0059271 A1* 3/2015 Tsai ..... E04F 15/02194
52/302.1

* cited by examiner

WEEP HOLE INSERT SYSTEM

CROSS-REFERENCE TO RELATED APPLICATIONS

This application is an U.S. national phase application under 35 U.S.C. § 371 based upon co-pending International Application No. PCT/AU2014/000123 filed on Feb. 14, 2014. Additionally, this U.S. national phase application claims the benefit of priority of co-pending International Application No. PCT/AU2014/000123 filed on Feb. 14, 2014 and Australian Patent Application No. 2013211506 filed on Aug. 1, 2013. The entire disclosures of the prior applications are incorporated herein by reference. The international application was published on Feb. 5, 2015 under Publication No. WO 2015/013736 A1.

TECHNICAL FIELD

The present invention relates to a vent insert and vent insert system. The insert and system have been developed primarily for use in a weep hole opening in a masonry wall and will be described hereinafter with reference to this application. However, the insert and system are not limited to this application and may also be used, for example, in underfloor vents, retaining walls and tilt-up concrete walls.

BACKGROUND

In cavity brick or block masonry construction, weep hole openings are left in mortar joints just above the flashing to allow both ventilation and drainage of the wall cavity between the exterior masonry and the interior wall. A weep hole opening is typically formed by the omission of mortar between two adjacent bricks or blocks. The weep hole opening provides ventilation and drainage to keep the wall cavity dry. Without adequate ventilation, dampness causes mildew and rot, which reduce the life of the structure.

Weephole openings vary considerably in size and shape dependent on the skill and care of the tradesmen and the type of brick and type of finishes being applied. A problem with weep hole openings situated close to ground level, as are common, is that they can become an entry for rodents and reptiles. Similarly, a problem with weep hole openings around windows or second floors is that they can provide an entry for insects. In particular, the weep hole opening leading to the wall cavity is an ideal home for bees, wasps and other insects, which themselves create food sources for other pests. Another problem associated with weep hole openings is that they provide an entry point for water, particularly during excessive rain or from garden sprinklers. Another problem with weep hole openings is that they can allow sparks and firebrands to penetrate a building.

SUMMARY

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In a first aspect, the invention provides an insert for providing a barrier in a weep hole in a masonry wall, said insert comprising:

a body comprising:

a spine portion defining a longitudinal axis and having a reinforcing rib extending therearound, and a resilient fringe extending at least partially around the spine portion and adapted to engage walls of the weep hole, wherein the insert is formed from metal sheet that is strengthened by the reinforcing rib.

Openings may be formed in the spine portion. The openings may be axially spaced apart along the longitudinal axis. Some of the openings may be provided on one lateral side of the plane of the spine portion and some of the projections may be provided on the opposite lateral side of the plane.

The reinforcing rib may be defined by a deformed portion of the metal sheet. The metal sheet may be stainless steel sheet.

The fringe may be formed by radially inwardly extending slits around a periphery of the insert which define tabs therebetween.

The fringe may extend along at least two sides of the body. In some embodiments, the fringe extends along three or four sides of the body.

The resilient fringe may be preformed with a curve away from a plane of the spine portion to facilitate insertion of the insert into the weep hole.

In a second aspect, there is provided a handle for facilitating manual insertion of an insert into a weep hole and manipulation of the insert within the weep hole, the handle comprising:

an elongate body, defining a longitudinal axis, the body having a proximal end and a distal end, the distal end being sized to fit within the weep hole and defining an elongate, substantially rectangular, abutment surface for abutting the insert; and projections extending longitudinally from the distal end of the body for engaging corresponding openings in the insert, wherein the projections are axially spaced apart along a major dimension of the distal end of the body, and wherein some of the projections extend from one lateral side of the distal end of the body and some of the projections extend from the other lateral side of the distal end of the body.

In a third aspect, there is provided a handle for facilitating manual insertion of an insert into a weep hole and manipulation of the insert within the weep hole, the handle comprising:

an elongate body having a proximal end and a distal end, the distal end being sized to fit within the weep hole; and a depth setting flange extending outwardly from the body between the proximal and distal ends, the depth setting flange being oversized relative to the weep hole opening so as to engage the weep hole during insertion of the insert to control an insertion depth of the insert, wherein a distance between the depth setting flange and the distal end is selected to correspond with a desired insertion depth of the insert.

The proximal end may be sized to fit within the weep hole, and a distance between the depth setting flange and the proximal end may be different to the distance between the depth setting flange and the distal end and may be selected to correspond with another desired insertion depth of the insert.

The depth setting flange may have a fixed position on the body, such as by being formed in unitary one-piece construction with the body. Alternatively, the depth setting flange may be longitudinally moveable along the body to adjust the desired insertion depth of the insert.

There is also provided an insert system for a weep hole, said system comprising:

an insert for providing a barrier in a weep hole in a masonry wall, said insert comprising a body having a spine portion and a resilient fringe extending at least partially around the spine portion, the resilient fringe being adapted to engage walls of the weep hole; and a handle according to the second or third aspect above, the handle being engageable with the insert to facilitate insertion of the insert into a weep hole.

The insert of the insert system may be an insert according to the first aspect above.

BRIEF DESCRIPTION OF DRAWINGS

Embodiments will now be described, by way of an example only, with reference to the accompanying drawing, in which.

DESCRIPTION OF EMBODIMENTS

Figure 1:
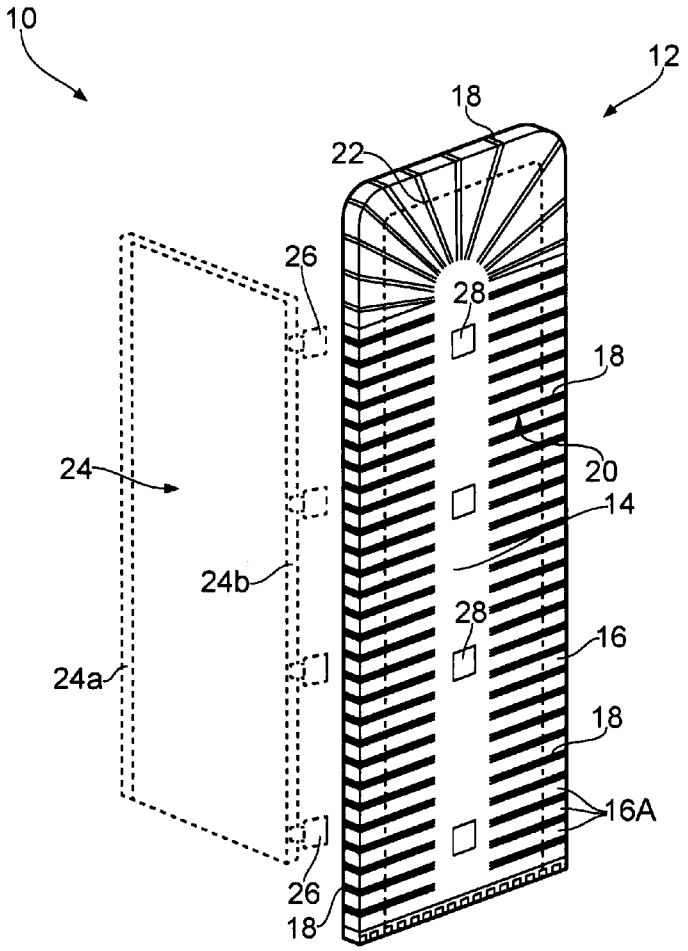
FIG. 1 is a perspective view of a first embodiment of an insert for a weep hole.
Figure 2:
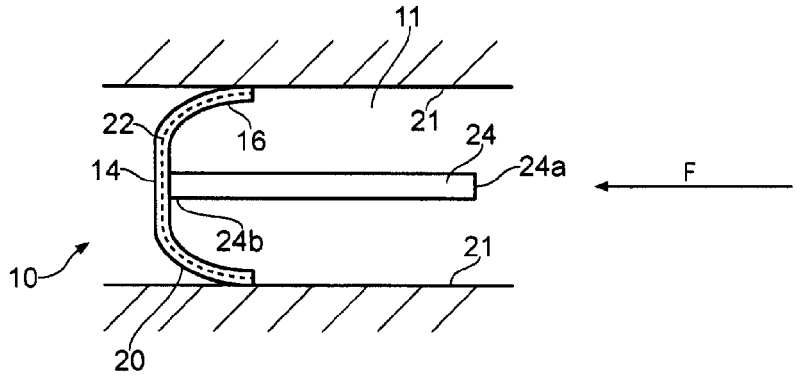
FIG. 2 is a top view of a weep hole in which the insert of FIG. 1 has been inserted.
Figures 3, 4:
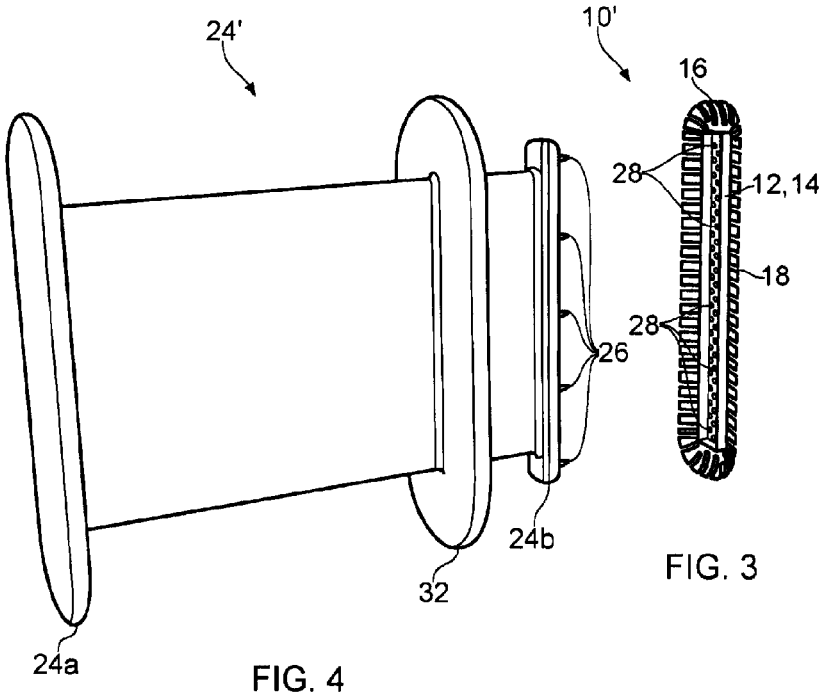
FIG. 3 is a perspective view of an alternative embodiment of an insert for a weep hole.
FIG. 4 is a perspective view of a handle for use with the insert of FIG. 3.

Referring initially to FIGS. 1 and 2, there is shown an insert 10 for a weep hole 11 in a masonry wall (not shown). The insert 10 comprises a unitary body 12 having a relatively rigid spine portion 14 and a resilient fringe 16 extending around the top and opposite side edges of the body 12. The fringe 16 is defined by slits 18 in the body 12 and is oversized relative to the size of the weep hole. A front (relative to a forward insertion direction F of the insert 10) surface 20 of the fringe 16 is adapted for engaging walls 21 of the weep hole 11. The body 12 is formed from linear low density polyethylene (LLDPE), which is a relatively low friction material, and as such facilitates insertion of the insert 10 into the weep hole 11. The fringe 16 is also impregnated with a pesticide, such that vermin that squeeze past the fringe 16 are dosed with the pesticide.

A mesh screen 22 is embedded in the body 12, and as such is spaced apart from the first side 20 of the fringe 16. Accordingly, when the insert 10 is inserted into the weep hole 11, the body 12 separates the mesh screen 22 from the walls 21 of the weep hole 11.

A detachable handle 24 is connected to the body 12 for facilitating manual insertion of the insert 10 into the weep hole 11 and manipulation of the insert 10 within the weep hole 11. The handle 24 has a proximal end 24*a* and a distal end 24*b* and includes a plurality of locking stubs 26 on its distal end 24*b* that are engageable with apertures 28 in the spine portion 14 of the body 12 to connect the handle 24 to the body 12. The apertures 28 also provide for ventilation of the weep hole 11 through the body 12. Engagement of the stubs 26 in the apertures 28, in combination with the rectangular shape and length of the distal end 24*b*, facilitate the insert 10 being resistant to twisting as it is inserted into a weep hole 11.

Prior to insertion in a weep hole 11, the detachable handle 24 is pre-assembled to the body 12. To install the insert 10, the user simply grips the handle 24 and aligns the body 12 with the weep hole 11. As shown in FIG. 2, the user then pushes the insert 10 into the weep hole 11 in a forward insertion direction, indicated by arrow F, using the handle 24, to the desired depth. During this insertion, outer ends of the fringe 16, and the mesh screen 22 embedded therein, fold back toward the weep hole 11 due to the oversizing of the fringe 16 relative to the weep hole 11. The resilience of the fringe 16 ensures that the individual elements 16*a* of the fringe are biased outwardly into engagement with the walls 21 of the weep hole 11 to anchor the insert 10 in place. Once installed, the handle 24 can be removed by disengaging the stubs 26 from the apertures 28, thereby opening the apertures 28 for ventilation through the weep hole 11.

It will be appreciated that the illustrated weep hole insert 10 advantageously facilitates insertion of a mesh screen 22 into a weep hole 11 by separating the mesh screen 22 from the weep hole walls 21 during insertion, thereby reducing friction and protecting the screen 22 from damage.

A second embodiment of a weep hole insert 10' is shown in FIGS. 3-6, and shares many features in common with the embodiment of FIGS. 1 and 2, where corresponding reference numerals indicate corresponding features with corresponding functionality. In the embodiment of FIGS. 3-6, however, the entire insert 10' is formed from stainless steel sheet. The resilient fringe 16 of the insert 10' is preformed with a curve away from a plane of the spine portion 14 to facilitate insertion of the insert 10' into the weep hole 11. The insert 10' has a reinforcing rib 30 formed on the body 12. The reinforcing rib 30 is substantially rectangular and extends around the spine portion 14 of the body 12, inwardly of the fringe 16. The reinforcing rib 30 is defined by a deformed portion of the stainless steel sheet. The handle 24' used with insert 10' includes a depth setting flange 32 intermediate the proximal and distal ends 24*a*, 24*b* and oversized with respect to the weep hole 11. The distal end 24*b* of the handle 24' is substantially rectangular and sized to both fit within the weep hole 11 and to engage the correspondingly shaped rib 30. The distance D between the distal end 24*b* and the flange 32 of handle 24' is selected to achieve a desired insertion depth of the insert 10 in the weep hole 11. The stubs 26 of handle 24' take the form of pins, which are grouped in laterally spaced apart pairs. A plurality of the pairs of pins are provided at spaced apart intervals along the distal end 24*b* of the handle. The engagement of the pairs of pins 26 in the apertures 28 of the insert 10', in combination with the rectangular shape and length of the distal end 24*b*, facilitate the insert 10' being resistant to twisting as it is inserted into weep hole 11. The handle 24' may be formed from a plastics material, such as PC or ABS. The handle 24' may also be used with other forms of weep hole inserts, including weep hole inserts formed from metal sheet, plastics, or composite materials, provided that such inserts have openings 28 for receiving the pins 26. In such other forms of weep hole insert formed from plastics or composite materials, the insert may be impregnated with a pesticide as discussed above with reference to the embodiment of FIGS. 1 and 2.

It will be appreciated that the weep hole insert system illustrated in FIGS. 3-6 advantageously facilitates insertion of weep hole insert 10' into a weep hole 11 by providing a rearwardly curved resilient fringe 16, a handle 24' and insert 10' with features that inhibit twisting of the insert 10' during its insertion into the weep hole 11.

Figure 5:
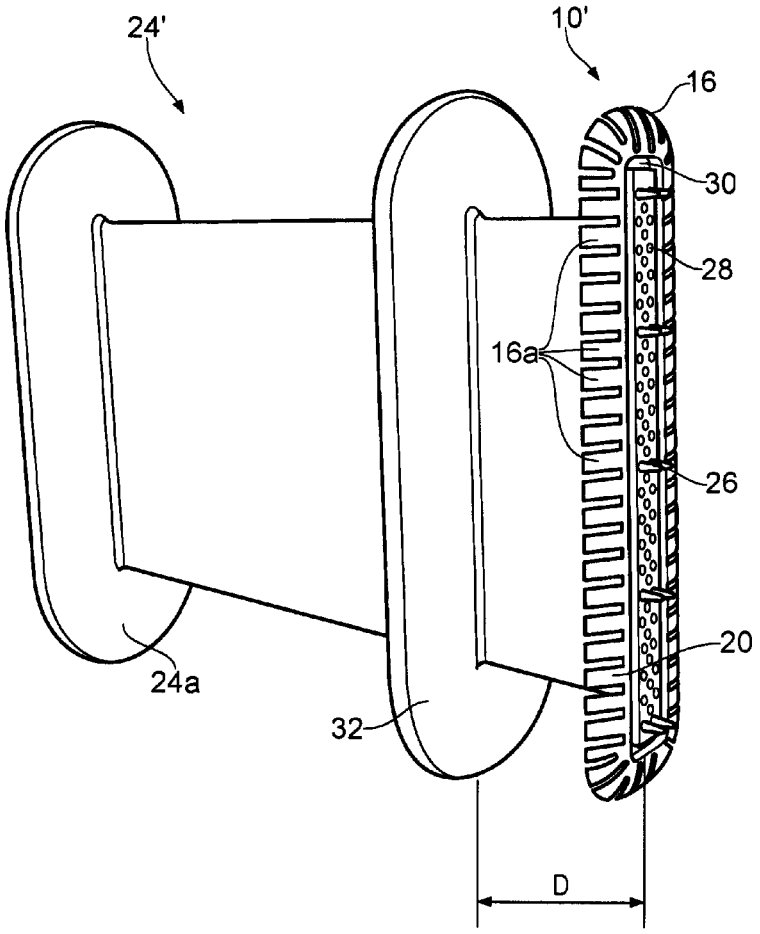
FIG. 5 is a perspective view of a weep hole insert system comprising the insert FIG. 3 and the handle of FIG. 4.
Figure 6:
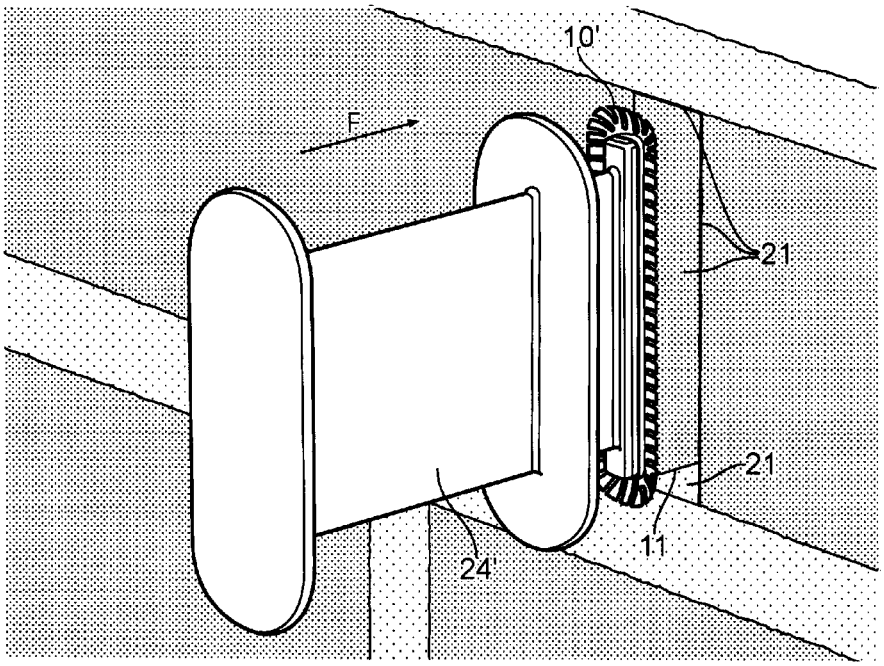
FIG. 6 is a perspective view of the weep hole insert system of FIG. 5 aligned with a weep hole.
Figure 7:
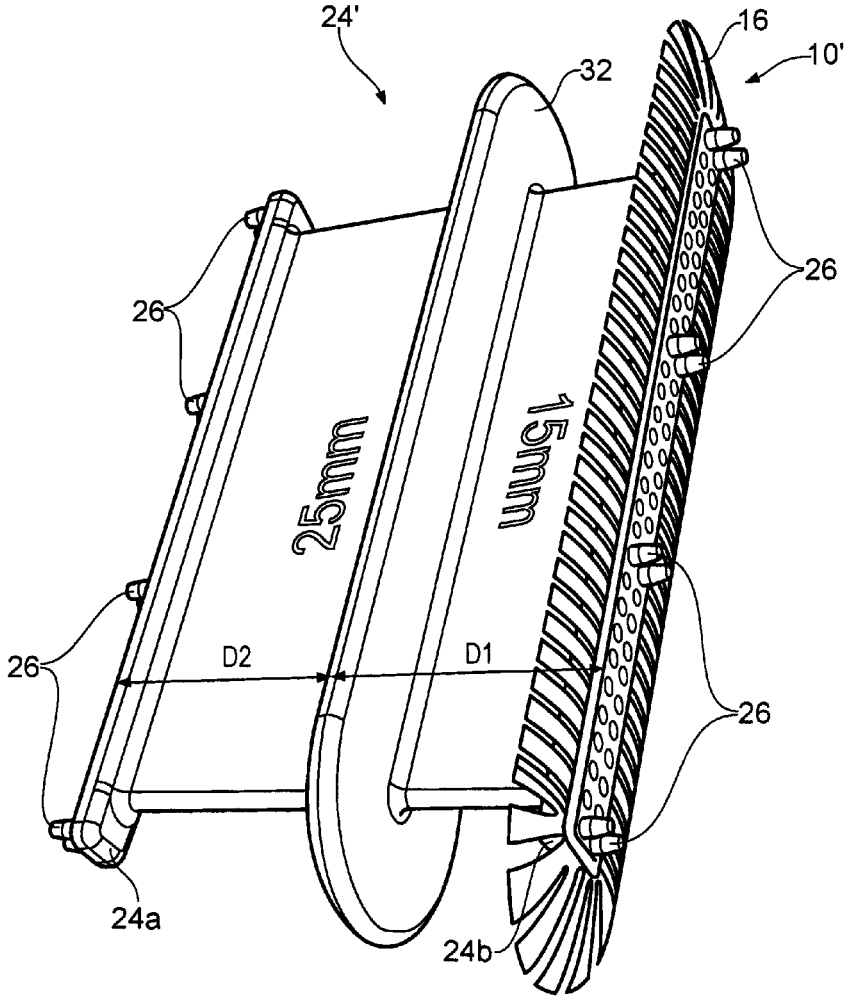
FIG. 7 is a perspective view of another embodiment of a weep hole insert system comprising the insert of FIG. 3 and an alternative handle embodiment.

Another embodiment of a weep hole insert system is shown in FIG. 7, which shares many features in common with the embodiment of FIGS. 5 and 6, where corresponding reference numerals indicate corresponding features with corresponding functionality. In the FIG. 7 embodiment, however, the handle 24' is double-ended and has stubs 26 at both its proximal and distal ends 24*a*, 24*b*, such that the insert 10' may be connected to either end of the handle. Moreover, the depth setting flange 32 is positioned such that its distance D1 from the distal end 24*b* is different than its distance D2 from the proximal end 24*a*, such that the insert may be connected to the particular end 24*a*, 24*b* that provides the desired insert insertion depth into the weep hole 11. In the illustrated embodiment, the distance D1 from the distal end is 15 mm and the distance D2 from the proximal end is 25 mm.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive. Examples of possible modifications and/or variations include, but are not limited to:

- other portions of the body 12 of insert 10 apart from the fringe being impregnated with pesticide;
- the mesh screen 22 used with insert 10 being connected to a rear side of the body 12 relative to a forward insertion direction F of the insert 10 into the weep hole 11;
- the body 12 of insert 10 or 10' being formed from other materials, such as polypropylene or fire-retardant acrylonitrile butadiene styrene (ABS) resin;
- the fringe 16 being provided only on opposite side edges of the body 12 or insert 10 or 10', or alternatively on all four edges of the body 12;
- the handle 24 being permanently connected to the body 12 of insert 10;
- the depth setting flange 32 may be longitudinally movably connected to the rest of the handle 24 to allow the insertion depth of the insert 10 to be adjusted;
- the metal sheet from which insert 10' is formed may be aluminium, brass, another type of steel, such as galvanised steel or powder-coated steel, or another metal sheet;
- the insert 10, 10' may include a plurality of substantially parallel, spaced apart fringes 16; and/or
- the insert 10, 10' may be formed in one piece or from a plurality of pieces that interconnect (e.g. the spine portion 14 may be formed from one piece and the resilient fringe 16 may interlock with the spine portion 14).

The claims defining the invention are as follows:

1. An insert for providing a barrier in a weep hole in a masonry wall, said insert comprising:

a body comprising:

a spine portion defining a longitudinal axis and having a reinforcing rib extending therearound, wherein said spine portion defines openings therein; and a resilient fringe extending at least partially around said spine portion and adapted to engage walls of said weep hole, wherein said insert is formed from metal sheet that is strengthened by said reinforcing rib, wherein said reinforcing rib is located inwardly of said fringe with said fringe extending outwardly from said reinforcing rib.

2. The insert according to claim 1, wherein said reinforcing rib is defined by a deformed portion of said metal sheet.

3. The insert according to claim 1, wherein said fringe is formed by radially inwardly extending slits around a periphery of said insert which define tabs therebetween.

4. The insert according to claim 3, wherein said fringe extends along at least two sides of said body.

5. The insert according to claim 1, wherein said resilient fringe is preformed with a curve away from a plane of said spine portion to facilitate insertion of said insert into said weep hole.

6. The insert according to claim 1, wherein said openings are axially spaced apart along said longitudinal axis.

7. The insert according to claim 6, wherein some of said openings are provided on one lateral side of a plane of said spine portion and some of said openings are provided on an opposite lateral side of said plane.

8. The insert according to claim 7, wherein said openings comprise several pairs of laterally spaced apart openings, with each of said pairs of said laterally spaced apart openings being axially spaced apart along said longitudinal axis.

9. The insert according to claim 1 further comprises a handle having a configuration capable of facilitating manual insertion of said insert into said weep hole and manipulation of said insert within said weep hole, wherein said handle comprising:

an elongate handle body, defining a handle longitudinal axis, said handle body having a proximal end and a distal end, said distal end and said proximal end being sized to fit within said weep hole and defining an elongate, substantially rectangular, abutment surface for abutting said insert; and projections extending longitudinally from said distal end and said proximal end of said handle body for engaging corresponding said openings in said insert, wherein said projections are axially spaced apart along a major dimension of said distal end of said handle body, and wherein some of said projections extend from one lateral side of said distal end of said handle body and some of said projections extend from a lateral side of said proximal end of said handle body.

10. The handle according to claim 9, wherein said projections comprise several pairs of laterally spaced apart and adjacent projections, with each of said pairs of projections being axially spaced apart along a major dimension of said distal end and said proximal end of said handle body, respectively.

11. The handle according to claim 10, wherein said handle further comprising:

a depth setting flange extending outwardly from said handle body between said proximal and distal ends, said depth setting flange being oversized relative to said weep hole so as to engage said weep hole during insertion of said insert to control an insertion depth of said insert;

wherein a distance between said depth setting flange and said distal end is selected to correspond with a desired insertion depth of said insert.

12. The handle according to claim 11, wherein said proximal end is sized to fit within said weep hole, and wherein a distance between said depth setting flange and said proximal end is different to said distance between said depth setting flange and said distal end and is selected to correspond with another desired insertion depth of said insert.

13. The handle according to claim 11, wherein said depth setting flange has a fixed position on said handle body.

14. The handle according to claim 11, wherein said depth setting flange is longitudinally moveable along said handle body to adjust said desired insertion depth of said insert.

15. An insert system for a weep hole, said insert system comprising:

an insert for providing a barrier in a weep hole in a masonry wall, said insert comprising an insert body having a spine portion and a resilient fringe extending at least partially around said spine portion, said resilient fringe having a configuration capable of engaging walls of said weep hole, said spine portion defines openings therein, said openings are axially spaced apart along said longitudinal axis, wherein some of said openings are provided on one lateral side of a plane of said spine portion and some of said openings are provided on an opposite lateral side of said plane, and further wherein said openings comprise several pairs of laterally spaced apart openings, with each of said pairs of said laterally spaced apart openings being axially spaced apart along said longitudinal axis; and a handle having a configuration capable of engaging with said insert to facilitate insertion of said insert into said weep hole, said handle comprising an elongate handle body, defining a handle longitudinal axis, said handle body having a proximal end and a distal end, said distal end being sized to fit within said weep hole and defining an elongate, substantially rectangular, abutment surface for abutting said insert.

16. The insert system according to claim 15, wherein said handle further comprises projections extending longitudinally from said distal end of said handle body for engaging corresponding said openings in said insert, wherein said projections are axially spaced apart along a major dimension of said distal end of said handle body.

17. The insert system according to claim 16, wherein said handle further comprises a depth setting flange extending outwardly from said handle body between said proximal and distal ends of said handle body, said depth setting flange being oversized relative to said weep hole so as to engage said weep hole during insertion of said insert to control an insertion depth of said insert, and wherein a distance between said depth setting flange and said distal end is selected to correspond with a desired insertion depth of said insert.

18. The insert system according to claim 17, wherein said proximal end of said handle body is sized to fit within said weep hole, and wherein a distance between said depth setting flange and said proximal end of said handle body is different to said distance between said depth setting flange and said distal end of said handle body and is selected to correspond with another desired insertion depth of said insert.

19. The insert system according to claim 17, wherein said depth setting flange has a fixed position on said handle body.

20. The insert system according to claim 17, wherein said depth setting flange is longitudinally moveable along said handle body to adjust said desired insertion depth of said insert.

* * * * *